US005743308A

United States Patent [19]

Bassi et al.

[11] Patent Number: 5,743,308

[45] Date of Patent: Apr. 28, 1998

[54] DOUBLE LIFT WEAVE SYSTEM

[75] Inventors: Dario Bassi; Damien Bouchet, both of Chaponnay; Laurent Stocker, Caluire, all of France

[73] Assignee: Staubli Lyon, Chassieu, France

[21] Appl. No.: 761,382

[22] Filed: Dec. 9, 1996

[30] Foreign Application Priority Data

Dec. 12, 1995 [FR] France ..... 95 14882

[51] Int. Cl.[6] ..... D03C 3/20; D03C 3/06

[52] U.S. Cl. ..... 139/455

[58] Field of Search ..... 139/455

[56] References Cited

U.S. PATENT DOCUMENTS

| | | | |
|---|---|---|---|
| 4,858,654 | 8/1989 | Derudder | 139/455 |
| 5,038,837 | 8/1991 | Palau et al. | 139/455 |
| 5,373,871 | 12/1994 | Speich | 139/455 |

FOREIGN PATENT DOCUMENTS

| | | |
|---|---|---|
| 550199 | 12/1959 | Belgium . |
| 0055199 | 6/1982 | European Pat. Off. . |
| 0154823 | 9/1985 | European Pat. Off. . |
| 1523252 | 6/1968 | France . |
| 3724686 | 2/1989 | Germany . |
| 60-110950 | 6/1985 | Japan . |
| 4050335 | 2/1992 | Japan . |
| 2047755 | 3/1980 | United Kingdom . |

*Primary Examiner*—Andy Falik
*Attorney, Agent, or Firm*—Dowell & Dowell

[57] ABSTRACT

A double-lift weave system comprising a plurality of hooks, each of which is provided with two arms mounted on a base and each of which includes a lift lip adapted to cooperate with one of the knives of two griffe frames moving in phase opposition in a reciprocating movement. The position of each lip is controlled in order to be selectively moveable with respect to a knife by an actuator disposed between the two arms. Each hook further includes two open shed heels which are controlled by the actuator and adapted to cooperate with open shed bars so as to be moveable with respect to the bars. The system is particularly applicable to weaving looms.

18 Claims, 9 Drawing Sheets

116f
116a
XII
118a
118f
117a
117c
117b
104
105
116d
115
115a
116e
117d
103
116g
117a
116f
102
105
104
118d
116c1
117b
117c
116b1
118e
109
110
109
118g
110
116b
117d
116c
115
XII
116d
117
103
102
118b
116h
115a
118c
116g
117
116
106c
118h
116b1
106c
116a
106a
116b
118
106
106a
106
116h
100
116
106b
108
100

DOUBLE LIFT WEAVE SYSTEM

FIELD OF THE INVENTION

1. Background of the Invention

The present invention relates to Verdol-type weave systems of the so-called double lift type, and to weaving looms equipped with such systems.

2. History of the Related Art

Systems of the type in question which are, for example, described in Patent FR 1 523 252, generally comprise double hooks of which the two arms may cooperate respectively with the knives of one and the other of two griffe frames moving in phase opposition, i.e. animated by reciprocating movements phase-shifted by 180°. Each arm is provided with an open shed heel adapted to rest on one of the bars of an open shed screen when it is desired to maintain the hook high. In the free state, each hook rests on a bottom board defining the lower position of the corresponding warp yarn.

Means are also provided for acting, as a function of a program depending on the weave of the fabric, on one or the other of the arms of the hooks to deflect them. These known means are in the form of a train of bars acting on needles which cooperate with the arms of the hooks, the bar train operating as a function of the reading of needles with respect to the perforations of a paper tape which correspond to the desired weave. In the state of rest, the needles normally retain the hooks in the position of engagement, their displacements bringing them in the retracted position.

It will be readily appreciated that the Verdol-type systems as described in FR 1 523 252, are incapable of attaining high operational speeds due to the inertias, particularly of the needles, and to the paper reading time. Similarly, as the hooks have a high inertia, they are a serious obstacle to rapid displacements.

British Patent 2 047 755 also discloses a shed forming device in a weaving loom, of which the harness cords are associated with the fork joint of a pulley surrounded by a funicular element of which each of the two ends is secured with a flexible blade. The blades are driven in reciprocating manner by two griffe frames. The ends of the blades are each provided with a catch adapted to hook in an upper position on a knife when they are deflected by an electro-magnet disposed between the two blades, while the lift lips are permanently in mesh or on the path of two knives carried by griffe frames.

This mechanism is of completely different design from that of FR 1 523 252, since there are no hooks as such, their being replaced by the assembly of the two flexible blades connected by a cord surrounding a pulley. The principal drawback of this mechanism is the existence of the pulley whose rotation causes heating which is detrimental to good general functioning. In addition, this pulley wears out and a preventive change of several thousands pulleys must be provided during certain maintenance operations for this mechanism. Such maintenance is long and requires specialized manpower, which increases the working costs.

The improvements forming the subject matter of the present invention aim at overcoming the drawbacks set forth, by providing a weave system of the type described hereinabove, using double hooks capable of working at very high speed.

To that end, the bar train and the needles effecting the conventional press on the double hooks are replaced by an actuator placed between the arms of each hook and suitably controlled.

SUMMARY OF THE INVENTION

The present invention therefore relates to a double-lift weave system of the type comprising a plurality of hooks each provided with two arms, mounted on a common base and respectively bearing a lift lip adapted to cooperate with one of the knives of two griffe frames moving in phase opposition in a reciprocating movement. The said lip is controlled, in order to move with respect to the knife, by an actuator disposed between the two arms, and in that the hook further bears two open shed heels adapted to cooperate with open shed bars. The open shed heels, in order to move with respect to the bars, are controlled by the actuator.

The actuator may be an electro-magnet supplied sequentially from a program with a view to controlling displacement of the lift lips with respect to the knives of the griffe frames. It may also be a supple spreader displaced by an electro-magnet or any other appropriate device.

The invention also relates to a weaving loom equipped with a weave system as described hereinbefore.

BRIEF DESCRIPTION OF THE DRAWINGS

The invention will be more readily understood on reading the following description of three embodiments of a weave system according to the invention, given solely by way of example, with reference to the accompanying drawings, in which.

DESCRIPTION OF PREFERRED EMBODIMENTS

Figure 1:
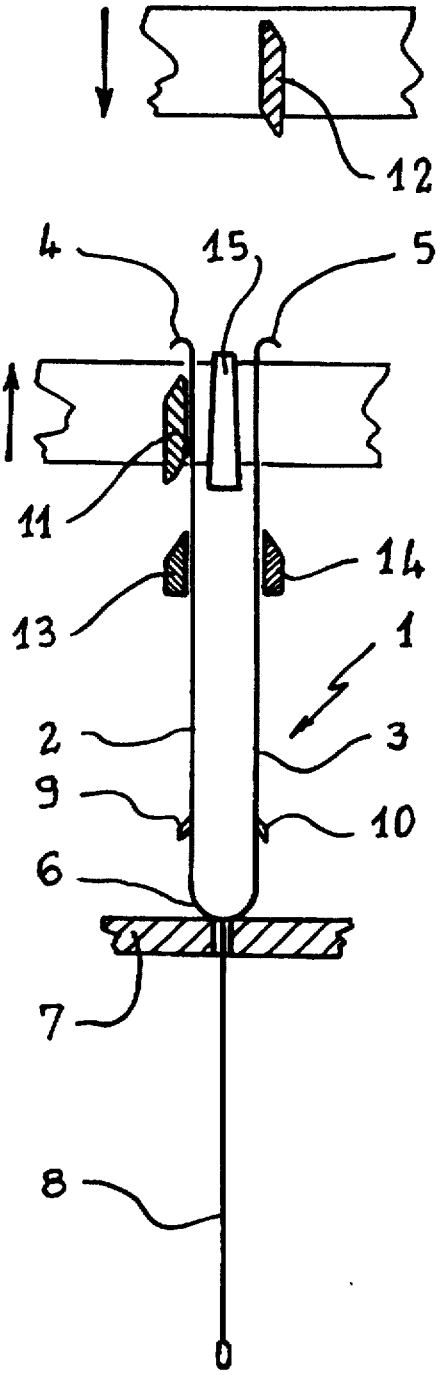
FIGS. 1 to 10 schematic illustrational views of a double hook of a weave system according to the invention in the various positions of its operational cycle.

Referring now to the drawings, FIG. 1 schematically shows a double hook 1 of a system according to the invention in its lower position. This hook is in the form of a U of which the two arms 2, 3 are formed by supple metal blades respectively terminated by an outwardly curved lift lip 4, 5. The central part or base 6 of the hook 1 rests against the upper face of a fixed bottom board 7 suitably pierced so as to allow passage for a cord 8 connected to a heddle and to each hook.

The system according to the invention conventionally comprises two griffe frames of which only one knife 11, 12 respectively, has been shown schematically for each of them, these knives moving vertically, in reprocating manner and in phase opposition.

In accordance with the invention, there is disposed between the two arms 2 and 3 of each hook and just below their lift lips 4, 5 when the hook is at rest against the bottom board 7, an electro-magnet 15 suitably supplied sequentially from a program depending on the weave of the fabric and effected in known manner, for example by a computer program.

Operation is as follows:

In FIG. 1, assuming that electro-magnet 15 is not supplied, arms 2 and 3 of the hook are not deformed and the rising knife 11 will seize the lift lip 4 of arm 2 of the hook to raise the hook.

Figure 2:
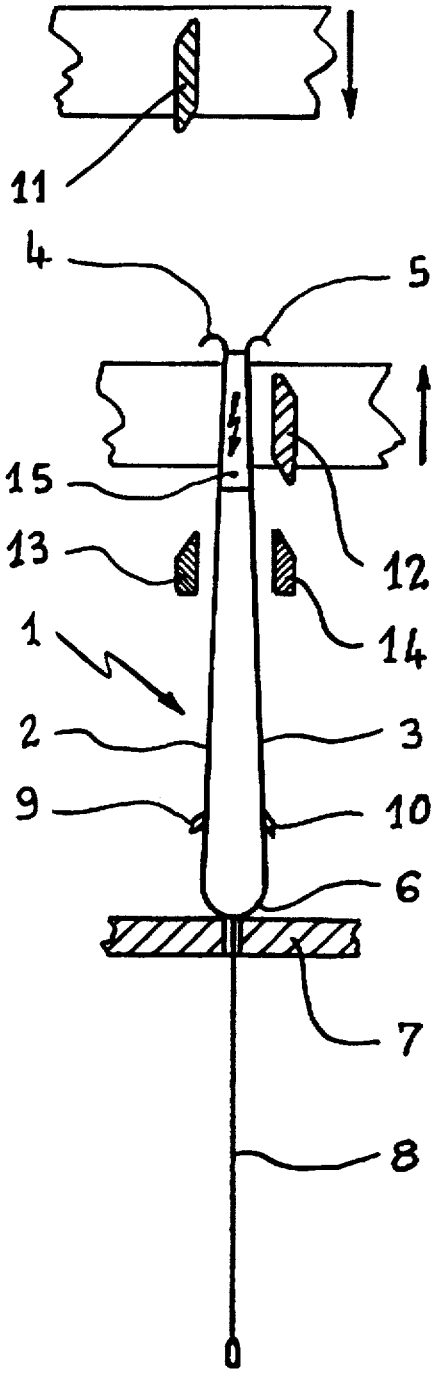

On the contrary, as shown in FIG. 2, if, in the same position of hook 1, the electro-magnet 15 is supplied, the two arms 2 and 3 adhere against this electro-magnet, with the result that they are deflected by a distance such that the lift lip 5 of arm 3 is not seized by knife 12 in the course of rising.

Figure 3:
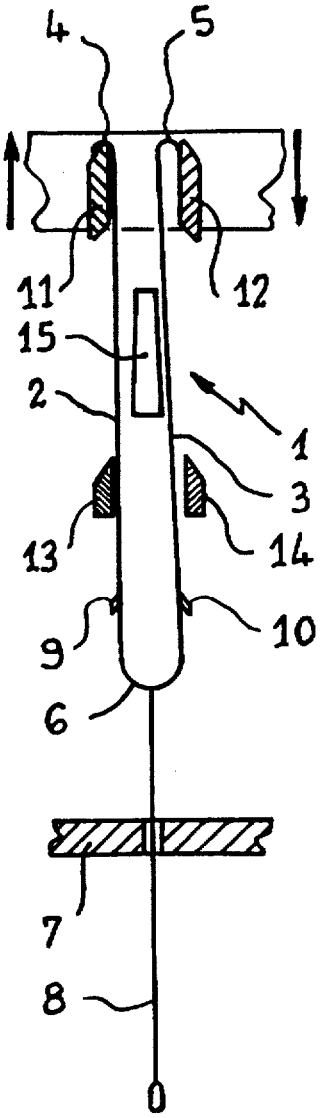

FIG. 3 shows the phase which follows the position of FIG. 1 at the moment when knives 11 and 12 pass each other. At that instant, taking into account the shape of the lower part of knife 12, the lift lip 5 and arm 3 are displaced in the direction of the electro-magnet 15, which is not activated, by abutment of the lower part of knife 12 against the upper part of the lip 5. In other words, knife 12 drives lip 5 away from its path during its descending movement.

In accordance with a variant of the invention (not shown), lip 5 may be displaced out of the path of knife 12 by activation of the electro-magnet 15 which attracts arm 3. This variant avoids the repeated mechanical rubbing contacts between the lower part of knife 12 and the upper part of lip 5, but requires more numerous activations of the electro-magnet 15.

It may be noted that the electro-magnet 15 is adapted to displace the lift lip 5, even if the latter is not opposite the electro-magnet, as the blade 3 is metallic and capable of reacting to the magnetic field induced by the electro-magnet whatever the height of the hook 1 with respect to the bottom board 7, i.e. whatever the position of the electro-magnet 15 in the space located between arms 2 and 3 of hook 1.

Each of arms 2, 3 of hook 1 is provided in its lower part adjacent the central part 6, with an open shed heel 9, 10 respectively, made by means of a downwardly oblique segment. The system further comprises an open shed screen or grid of which two bars 13, 14 have been shown on either side of arms 2 and 3 of the hook and outside.

Figure 4:
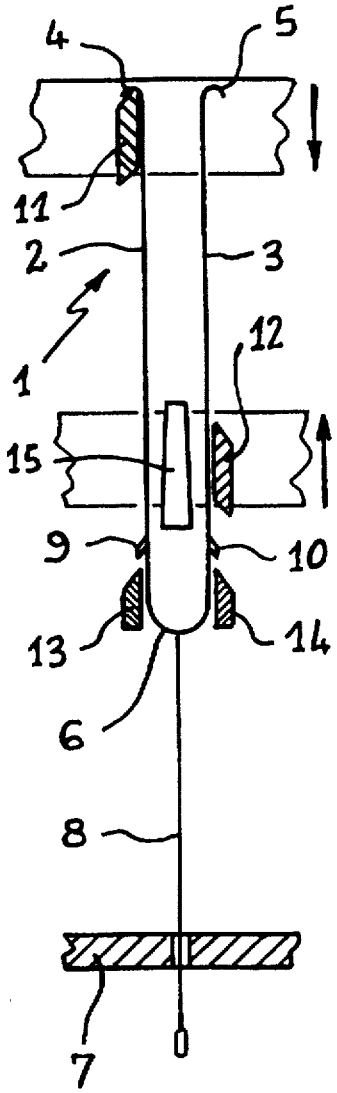
Figure 5:
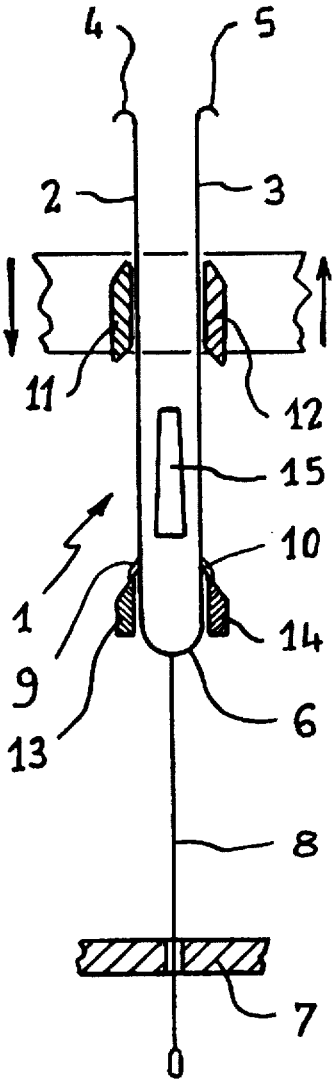
Figure 6:
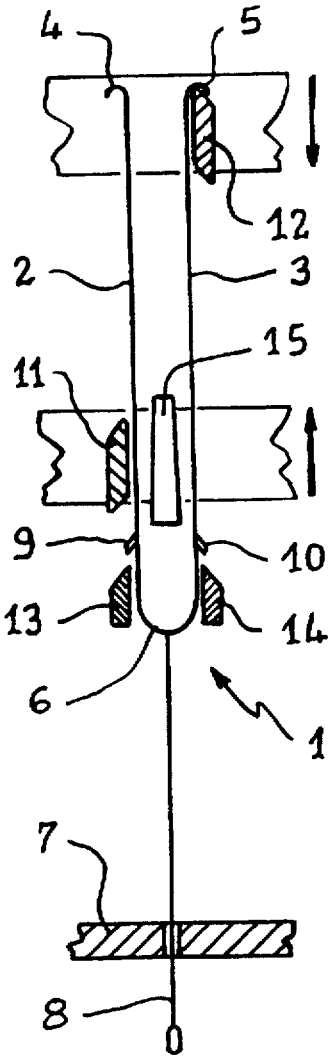

FIG. 4 illustrates the upper end position of the hook once the knife 11 has attained its highest position and it consequently begins its descending stroke. In this Figure, the electro-magnet 15 is not supplied and the hook begins a descending movement. However, as illustrated in FIG. 5, being given that arms 2 and 3 are not deflected, the open shed heels 9 and 10 will rest on the bars 13, 14 of the open shed screen. As long as the electro-magnet 15 is not supplied, the hook remains in its upper position shown in FIGS. 4 to 6.

Figure 7:
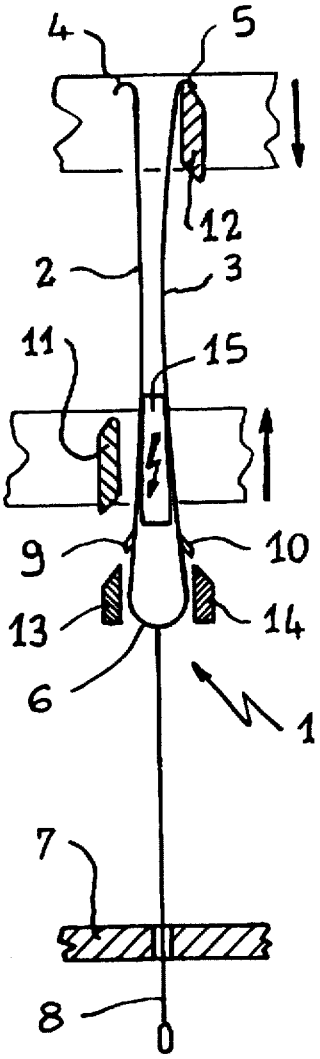

When it is desired to lower hook 1, i.e. to release the open shed heels 9 and 10 from the bars 13 and 14, the electro-magnet 15 is supplied, while one of the knives is on the point of descending, with the result that the two arms 2 and 3 of the hook 1 are deformed inwardly and come into abutment against the electro-magnet 15, as shown in FIG. 7. The open shed heels 9 and 10 are displaced inwardly of the base, so that, when the hook descends, the heels 9 and 10 do not cooperate with the bars 13, 14 and the base descends towards the board 7 under the effect of gravity or of the return force of a spring (not shown) hooked at the end, not visible, of a heddle connected to the cord 8.

Figure 8:
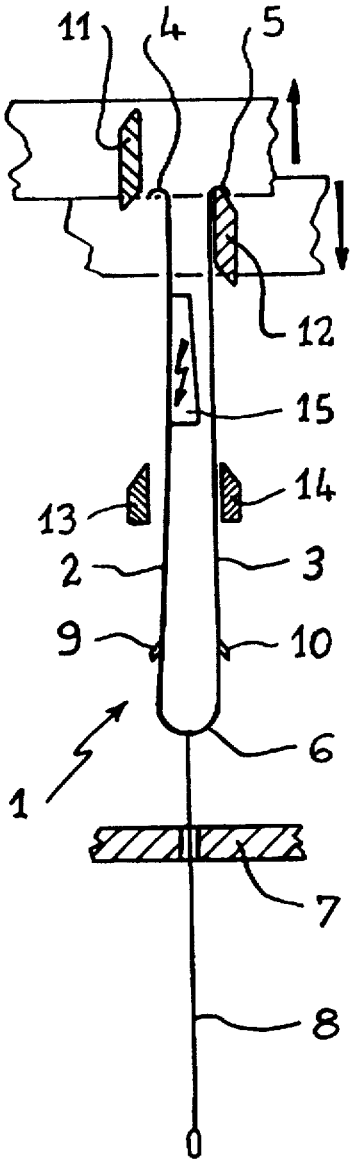

The hook continues to descend, as illustrated in FIG. 8, and, when knives 11 and 12 are on the point of crossing each other, the electro-magnet 15 is supplied, deflecting the arm 2 of the hook so that its lip 4 is not seized by the rising knife 11.

Figure 9:
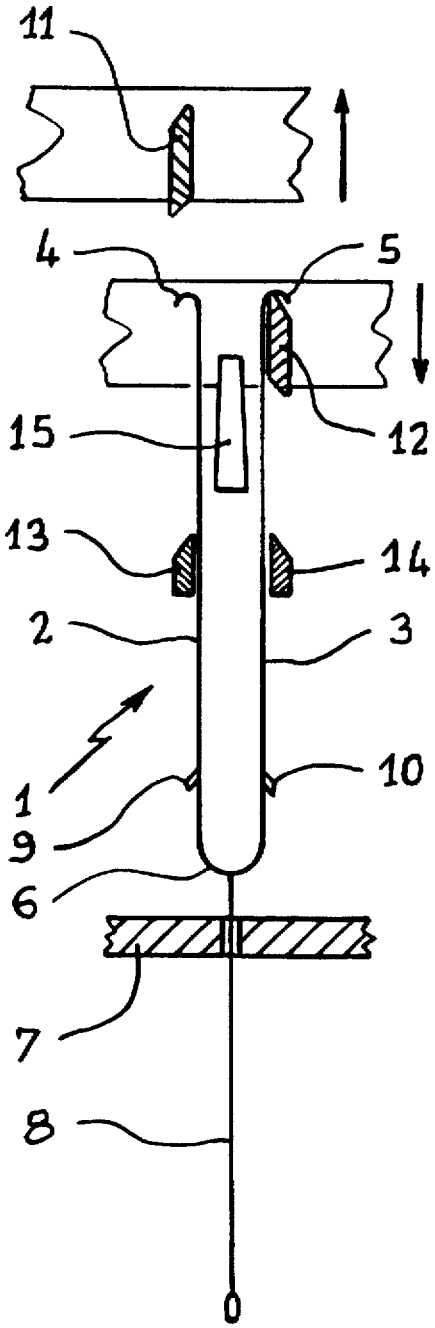
Figure 10:
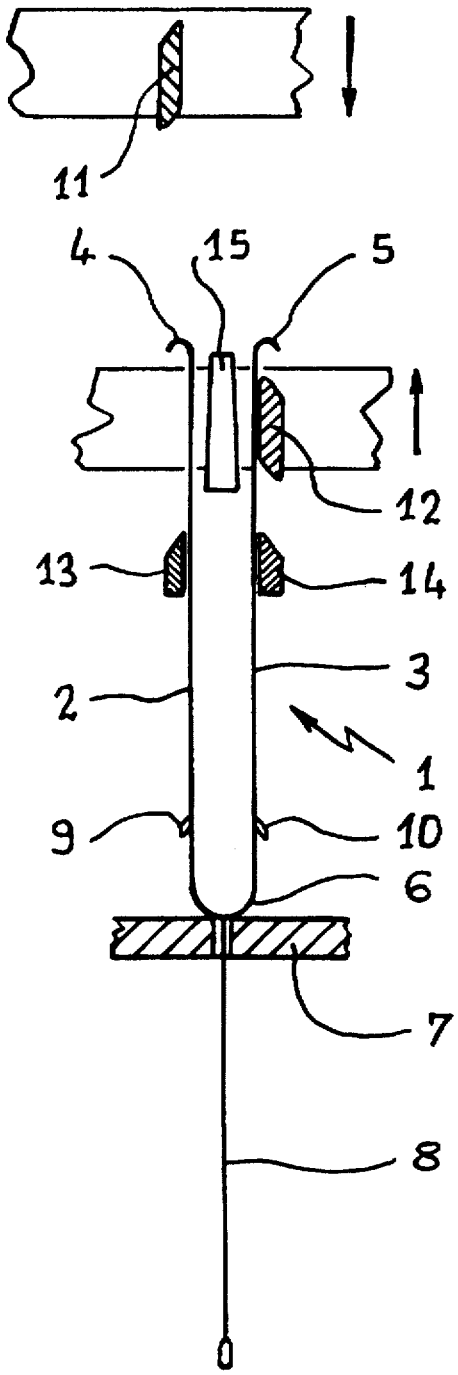

FIG. 9 illustrates the end of the descending movement of the hook after supply of the electro-magnet 15 has ceased. The end of downward stroke is illustrated in FIG. 10 in which the central part or base 6 of the hook rests against the fixed bottom board 7. The position is then similar to that of FIG. 1 where the hook is going to be raised, in the present case by knife 12 which is ascending.

It follows from the foregoing description that the electro-magnet 15 is capable not only of controlling displacement of the lift lips 4 and 5 with respect to knives 11 and 12, but also of displacing the open shed heels 9 and 10 with respect to the bars 13 and 14.

The embodiment of FIGS. 1 to 10 is particularly simple, as the assembly of the hook 1, i.e. the two arms 2 and 3, the lift lips 4 and 5 and the base 6, is formed by a single bent rod on which the upper end of the cord 8 may be knotted.

Figure 11:
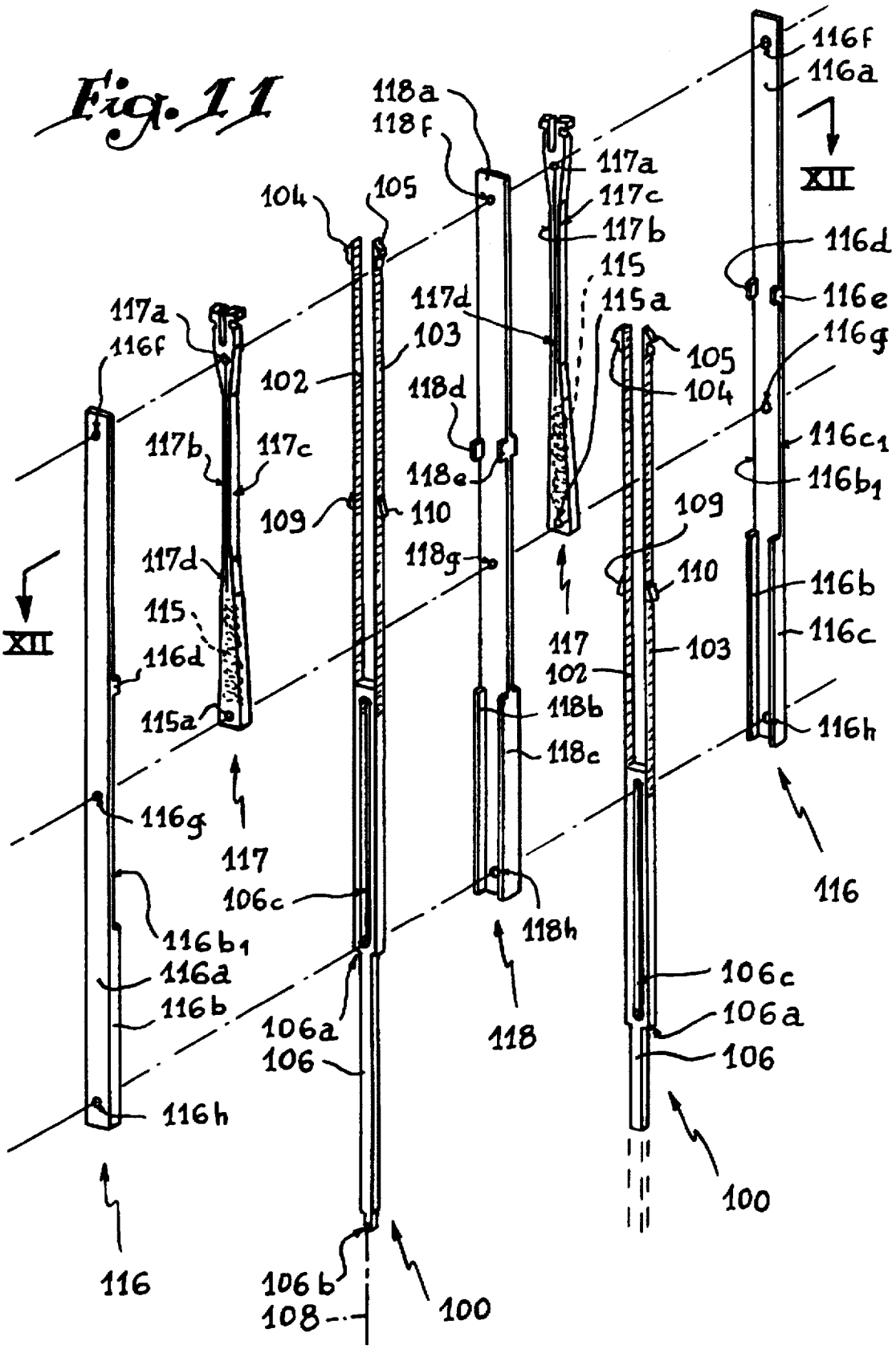
FIG. 11 is an exploded view in perspective of an assembly comprising two weave system hooks in accordance with a second embodiment of the invention.

FIG. 11 illustrates a second embodiment of the invention, showing two hooks in high and low positions.

In this embodiment, the hooks which are given general reference 100, comprise two spring steel plates referenced 102 and 103, these plates corresponding to arms 2 and 3 of the hook 1 of the previous embodiment. The free upper end of each plate 102, 103 respectively bears a lift lip 104, 105, while its lower end is fixed in a solid elongated base 106 of rectangular transverse section. The plates 102, 103 are preferably fixed with respect to the opposite two small sides of this section. The base 106 comprises a downwardly facing shoulder **106*a* adapted to rest, when hook 100 is in low position, against the bottom board 7 which has not been shown in FIG. 11. The lower end of base 106 comprises a hole 106*b* to which is attached a cord 108 connected to the corresponding heddle. The widest part of the base 106 is provided with a longitudinal slot 106*c*** whose role will be more readily explained hereinafter.

The presence of the two open shed heels 109 and 110 will be noted, fixed on the outer face of the plates 102 and 103 below the lips 104, 105 in a substantially median zone of the plates in question.

In a preferred embodiment, each hook may be disposed in a longitudinal cage adapted to guide its base and its plates, this cage being constituted by two partitions 116 forming slideway for the base 106 of the corresponding hook and for an electro-magnet 115. Moreover, in order to maintain this electro-magnet 115 in place with respect to the partitions 116, a core 117 is provided, whose upper end is assembled on the two partitions. The same applies to the lower part of the electro-magnet 115.

In this embodiment, it is observed that each partition. 116 is in the form of a U-section comprising a web **116*a* and two short flanges 116*b*, 116*c*. Flanges 116*b* and 116*c* embrace the base 106 of the hook at their lower parts, while the flanges are reduced over the rest of its height to two lower ribs 116*b*1 and 116*c*1 illustrated in FIG. 12. The two flanges are provided over a very short height substantially in the middle of that part of the partition which is reduced to web 116*a* and ribs 116*b*1 and 116*c*1. References 116*d* and 116*e* designate the two ears which are formed by the remaining part of the flanges mentioned previously. Thanks to holes 116*f*, 116*g* and 116*h*, two partitions 116 may be assembled, their flanges lying opposite to form the cage mentioned above, such assembly being effected by means of bolts or rivets traversing holes 116*f*, 116*h*. The assembling element passing in holes 116*f* also traverses a hole 117*a* in the core 117 so as to assemble the latter on the two partitions. The element traversing holes 116*g* in the partitions also traverses a hole 115*a* in the electro-magnet to effect fixation thereof, while the assembling element traversing holes 116***h* in the partitions passes through slot 106*c* in the base 106 of hook 100. A closed cage is thus produced on the lower part of the partitions 116, whose flanges come into contact with each other, in the same way, moreover, as the ends of the ears 116*d* and 116*e* which then form the open shed bars corresponding respectively to those, 13 and 14, of the embodiment of FIGS. 1 to 10. Of course, the ribs 116*b*1 and 116*c*1 form over the whole of their length a slideway for the corresponding plate, as illustrated more particularly in FIG. 12.

Figure 12:
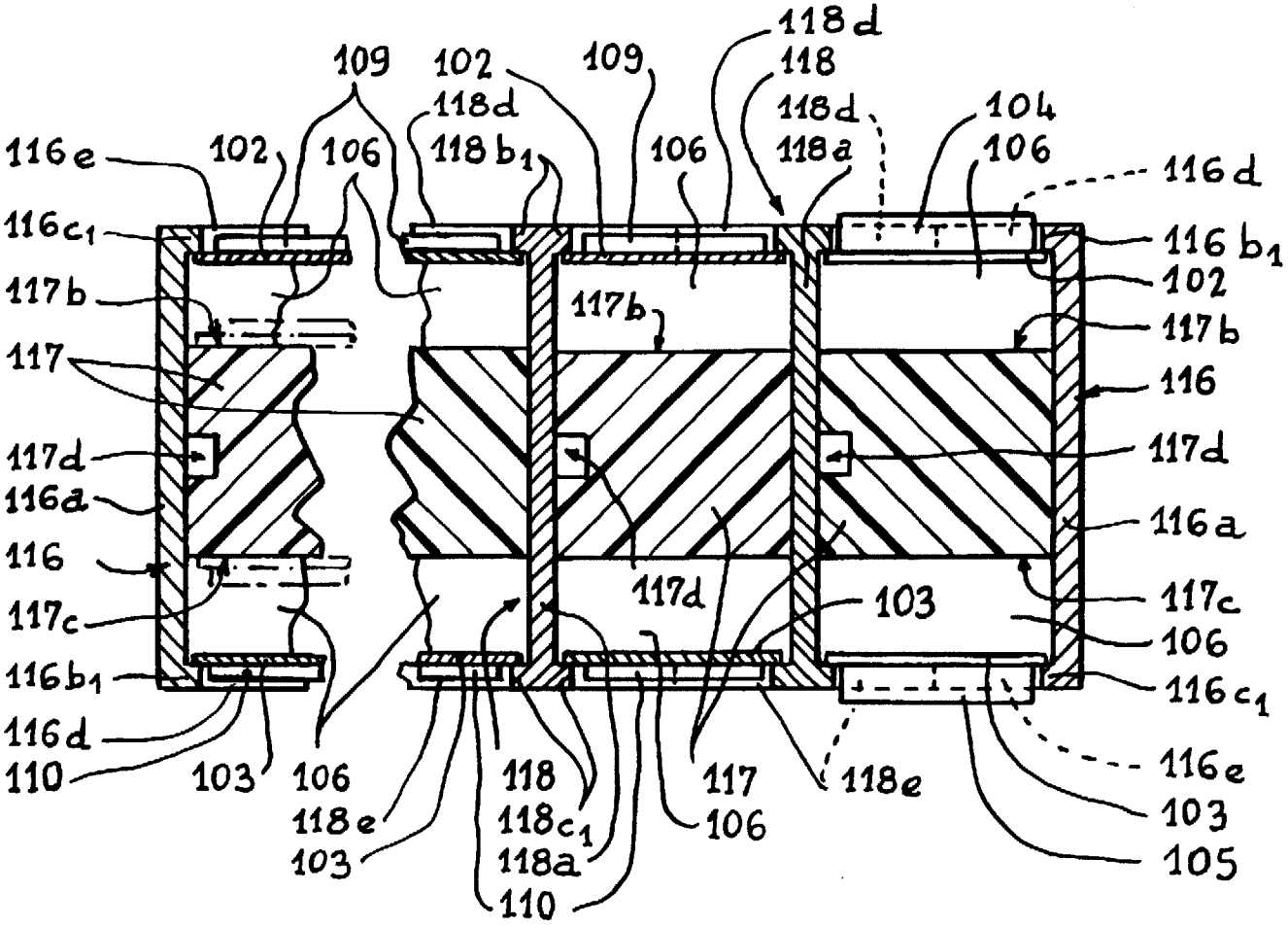
FIG. 12 is a view in section along line XII—XII of FIG. 11 in the case of more than two hooks being disposed side by side, the end plate located to the left of FIG. 11 having been pushed away to house at least one additional hook.
Figure 13:
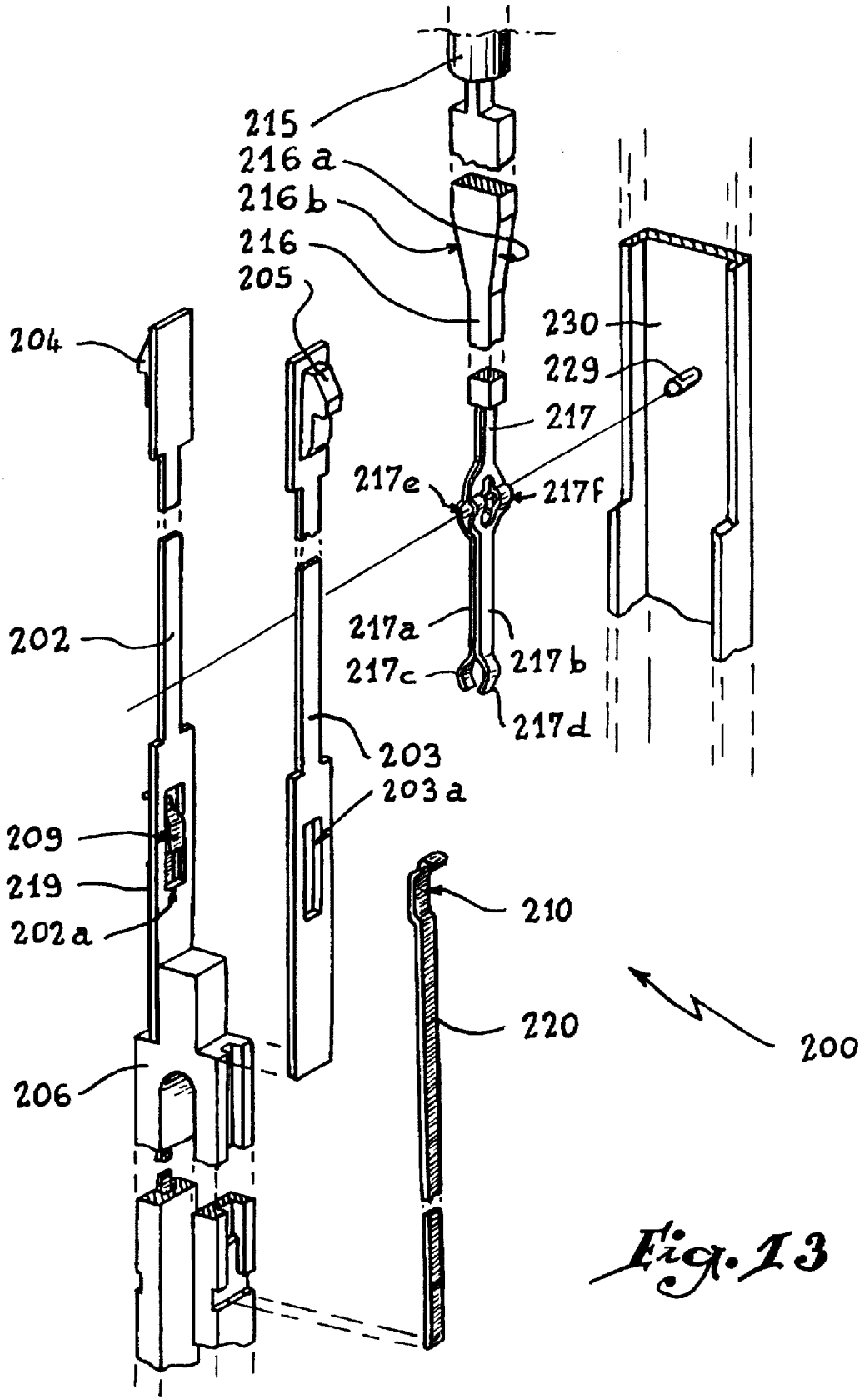
FIG. 13 is an exploded view in perspective of a weave system hook in accordance with a third embodiment of the invention.

In an advantageous embodiment, it is not one single cage which is used, but two end partitions 116 and a plurality of intermediate partitions 118 of I-section whose web is referenced 118*a*, while its flanges are referenced 118*b*, 118*c*. As for the end partitions 116, the flanges 118*b* and 118*c* are reduced on either side of the web 118*a* to ribs 118*b*1 and 118*c*1 intended to guide plates 102, 103 as illustrated in FIG. 12. The intermediate partitions 118 also bear, substantially in their median part, extensions 118*d* and 118*e* intended to form, together or with the corresponding extensions 116*d* and 116*e* of an end partition 116, open shed bars. Like the end partitions 116, the intermediate partitions 118 bear holes 118*f*, 118*g* and 118*h* respectively aligned with the holes 116*f*, 116*g* and 116*h* of the end partitions and allowing fixation of the electro-magnet 115 or of the core 117 or guiding of the base 106.

An independent module is thus produced, comprising a determined number of hooks, as is partially apparent in FIG. 12, one hook being able to be housed in a cage formed by two intermediate partitions 118 or by an intermediate partition 118 and an end partition 116. A module may contain, for example, eight hooks housed between two end partitions 116 and separated by seven intermediate partitions 118.

In the position of the hook 100 as illustrated on the right-hand side of FIG. 12, the lips 104 and 105 are carried by arms 102 and 103 which are spaced apart from one another as the electro-magnet 115 is not activated. The lift lips are then located above the open shed bars formed by the extensions 116*d*, 116*e*, 118*d* and 118*e* of the right-hand end partition and of the first intermediate partition from the right. In the upper position of the hook, as illustrated in the central part of FIG. 12, the open shed heels 109 and 110 appear above the open shed bars formed by the extensions 118*d* and 118*e* of two consecutive intermediate partitions 118. The hooks shown in the left-hand part of FIG. 12 are illustrated in upper position and the open shed heels 109 and 110 are also apparent.

It will be noted that the core 117 takes a shape such that two of its opposite faces constitute two ramps or recessed surfaces 117*b* and 117*c* against which the plates 102, 103 rest when the corresponding electro-magnet is supplied, as illustrated in discontinuous lines on the left-hand side of FIG. 12. When the electro-magnet is not supplied, the plates or arms 102 and 103 are in line with the opposite faces of the base 106. The presence is observed in this Figure of passages 117*d* arranged in the core 117 to allow supply of the electro-magnet from the top of this core. Operation of hook 100 is identical to that described with reference to FIGS. 1 to 10 for hook 1.

FIGS. 13 to 17 show a third embodiment of the invention in which the hook, which is generally referenced 200, comprises, as in the preceding embodiment, two plates or arms 202 and 203 made of spring steel, fixed on a base 206 and which bear, at their respective ends, lift lips 204 and 205. This embodiment differs from the previous one in that two open shed heels 209 and 210 are carried by two supple plates 219 and 220 fixed in the base 206. An orifice 202*a* and 203*a* is made respectively in each plate 202 and 203 so as to allow displacement of the open shed heels 209 and 210 perpendicularly to the plates 202 and 203.

Figure 14:
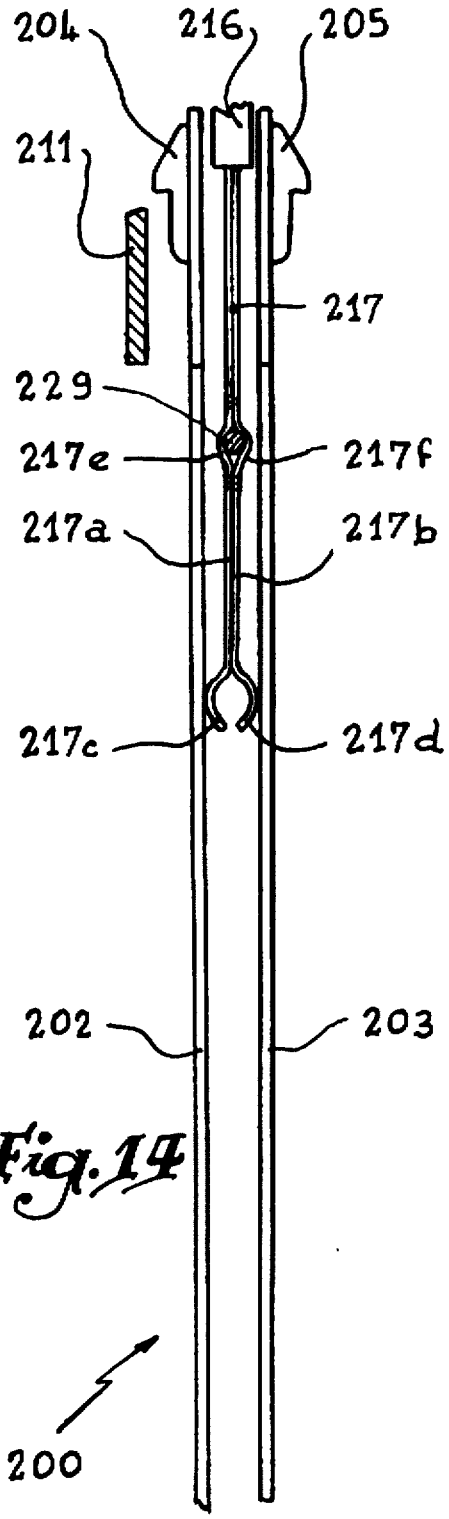
FIGS. 14 to 17 are schematic front illustrational views of the hook of FIG. 13 in different positions.
Figure 16:
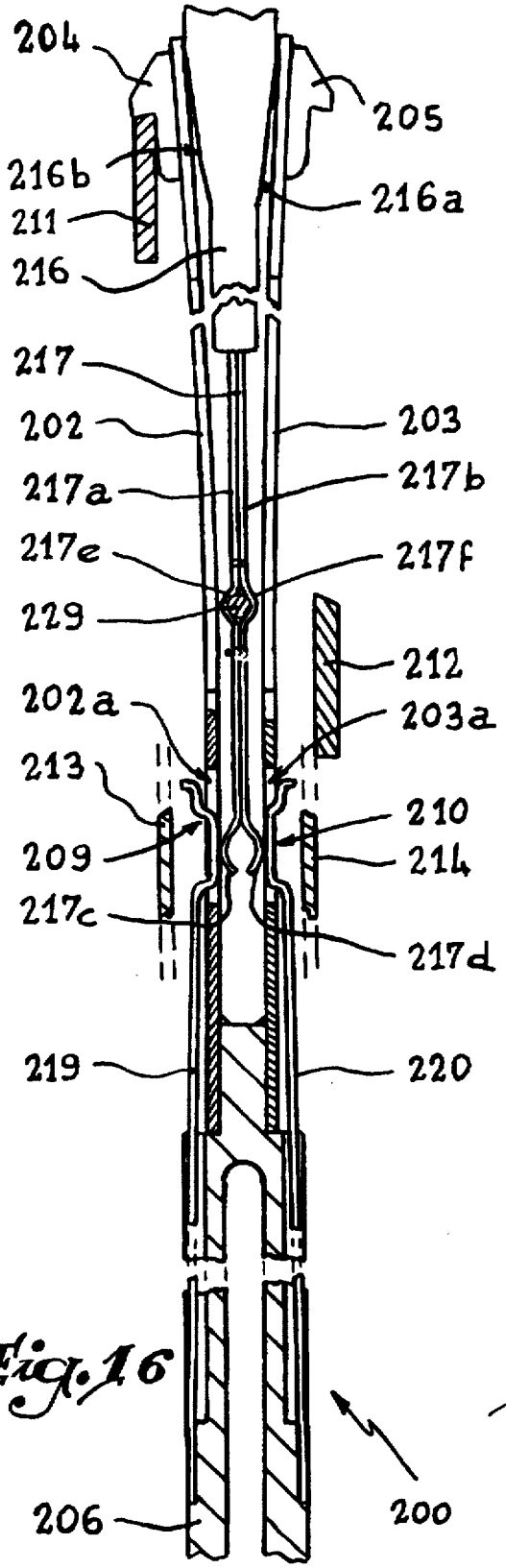

An electro-magnet 215 controls the vertical displacement of a rod 216, housed in the space located between arms 202 and 203, which extends by a spreader 217 formed by two supple steel blades 217*a* and 217*b* fixed to the lower end of rod 216. A bar 229 fixed on a box 230 is disposed between the blades 217*a* and 217*b* which comprise two curved parts 217*e* and 217*f* to follow its outer shape when the rod 216 is in high position, i.e. when the electro-magnet 215 is not activated. Blades 217*a* and 217*b* are respectively provided with two curved ends 217*c* and 217*d* which are virtually in contact with each other when the rod 216 is in high position, as is shown in FIGS. 14 and 16.

Figure 15:
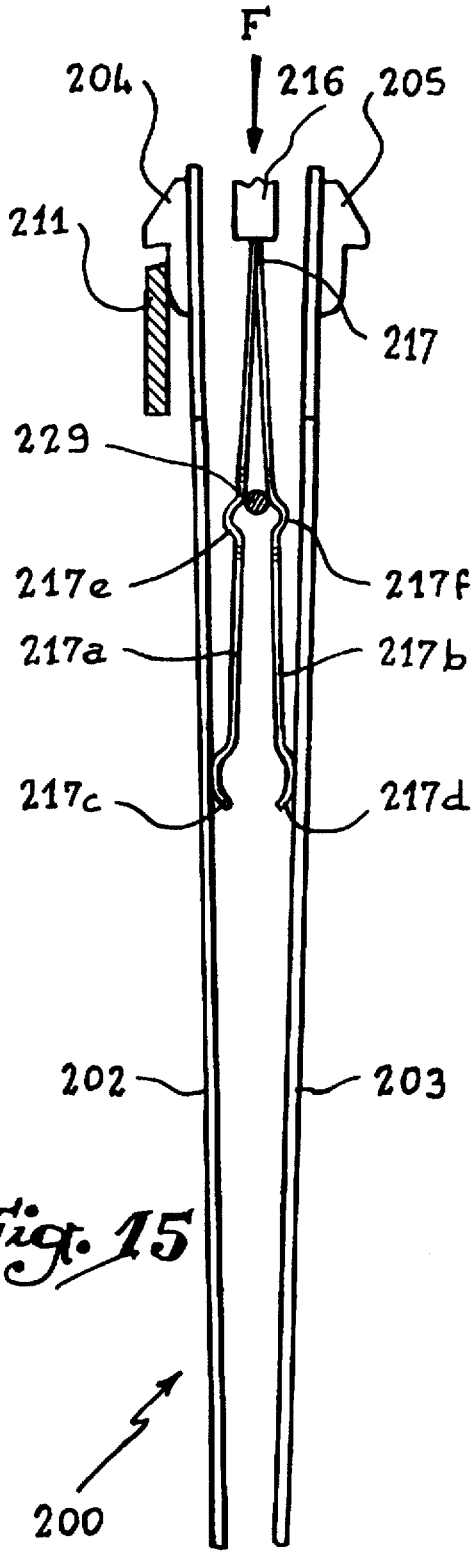
Figure 17:
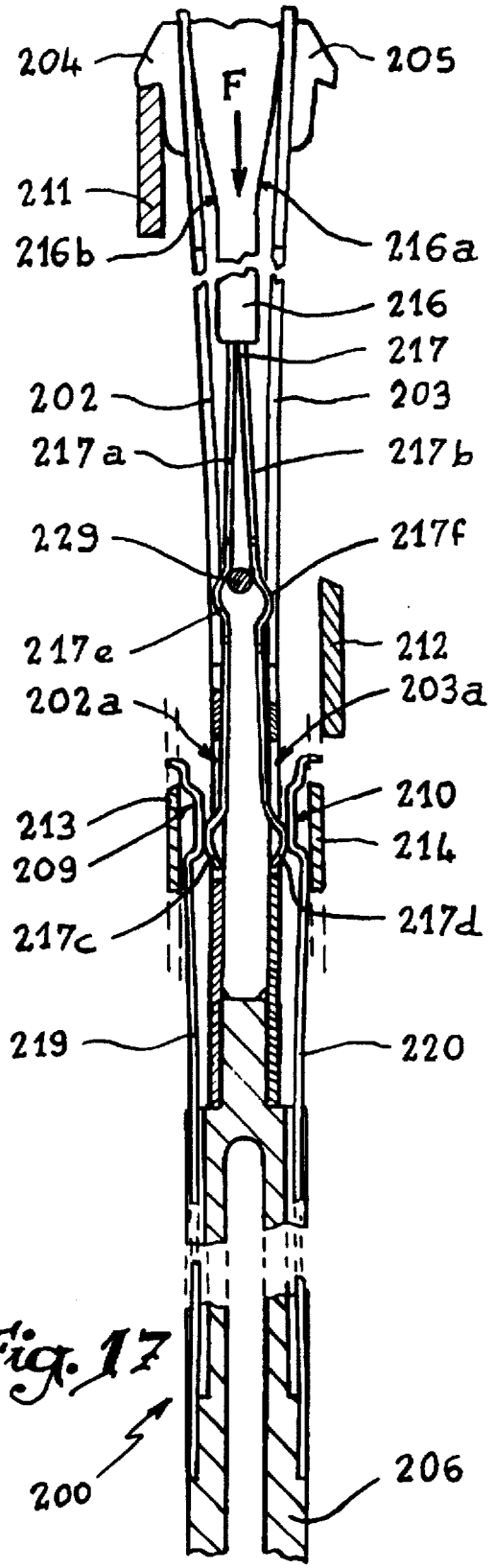

When the electro-magnet 215 is activated, rod 216 is displaced in the direction of base 206, i.e. downwardly and, as the spreader 217 bears on the fixed bar 229, the ends 217*c* and 217*d* are spaced apart from one another and outwardly push plates 202 and 203 when the device is in the position of FIG. 15 and the open shed heels 209 and 210 when the device is in the position of FIG. 17.

Operation of the system of FIGS. 11 and 12 is as follows:

In its starting position, hook 200 rests on a board equivalent to board 7 of the embodiment of FIGS. 1 to 10. The hook is in its lowest position and the lift lips 204 and 205 are disposed just above the bottom dead center of the paths of two knives 211 and 212 belonging to two griffe frames animated by a reciprocating movement in phase opposition, of which only one is visible in FIG. 14. As long as the weave of the fabric requires that the heddle connected to hook 200 remain in its lower position, i.e. in the lower part of the shed, the electro-magnet 215 is not activated and the knives 211 and 212 oscillate near the lips 205 and 206 without being in engagement therewith. The hook in that case remains in its position of FIG. 14.

When it is necessary to raise hook 200, the electro-magnet 215 is activated and rod 216 is pressed downwardly in the direction of arrow F, as appears in FIG. 15. Following the displacement of rod 216, the spreader 217 which is in abutment against the bar 229 tends to open and its curved ends 217*c* and 217*d* come into abutment against the inner faces of the plates or arms 202 and 203 which are deflected simultaneously outwardly, this having for consequence to displace the lift lips 204 and 205 on the path of knives 211 and 212. In the position shown in FIG. 15, the electro-magnet 215 is activated while the knife 211 is at the bottom dead center of its stroke, and lift lip 204 is on the path of knife 211 when the latter starts its upward movement. In this way, lift lip 204 hooks on knife 211 and the assembly of hook 200 and therefore the corresponding cord and heddle are raised to attain the corresponding upper position at the top dead center of the stroke of the knife 211, as shown in FIG. 16.

In the position shown in FIG. 16, hook 200 remains in abutment on knife 211 and redescends with the latter when it starts its downward stroke to the position illustrated in FIG. 14.

If the hook must remain in upper position as the corresponding heddle must pull warp yarns belonging to the upper part of the shed, the electro-magnet 215 is activated and the device is then in the configuration of FIG. 17. Taking into account the high position of hook 200, it is no longer the intermediate parts of the plates or arms 202 and 203 which are opposite the curved ends 217*c* and 217*d* of the spreader 217, but the open shed heels 209 and 210.

Due to the effort F exerted by the electro-magnet 215 on the rod 216 and the spreader 217, the latter deforms as shown with reference to FIG. 15 and the ends 217*c* and 217*d* of spreader 217 come into abutment against the inner face of the open shed heels 209 and 210. These heels are thus spaced apart above two open shed bars 213 and 214 equivalent to bars 13 and 14 of the first embodiment and fixed with respect to box 230 of the device and to bar 229. In this way, due to the action of the electro-magnet on rod 216 and on spreader 217, when knife 211 starts its descending movement, the open shed heels are spaced apart and they come into abutment on the open shed bars 213 and 214, which has for consequence to maintain hook 200 in high position.

Hook 200 remains in high position during the whole movement of descent of knife 211 which corresponds to the movement of rise of knife 212 which, at the end of stroke, lifts hook 200 slightly as the lift lip 205 is on its path due to the upper part of rod 216 presenting two divergent surfaces 216*a* and 216*b*, which move the lift lips 204 and 205 apart when hook 200 is in high position. In this way, at top dead center of its stroke, knife 212 has lifted the hook 200 assembly with respect to its position when the open shed heels 209 and 210 rest on the open shed bars 213 and 214.

Under the effect of the elasticity of plates 219 and 220 which are slightly cambered inwardly of base 206, the open shed heels 209 and 210 resume their position of FIG. 16, unless they are pushed again by the curved ends 217*c* and 217*d* of the spreader 217*d* pushed downwardly by the electro-magnet 215. If the electro-magnet 215 is not activated, the open shed heels 209 and 210 escape the open shed bars 213 and 214 and the hook 200 assembly has a descending movement in abutment on knife 212, until it attains the position of FIG. 14, where it remains until the electro-magnet 215 is again activated in order that spreader 217 pushes the lift lips 204 and 205 outwardly.

Spreader 217 is thus an actuator, disposed between arms 202 and 203, which controls displacement of lips 204 and 205 with respect to knives 211 and 212.

A particular advantage of the weave system of this embodiment lies in the fact that, as lift lips 204 and 205, on the one hand, and the open shed heels 209 and 210, on the other hand, are carried by different arms or plates 202, 203, 219 and 220, respectively, it is not necessary to deflect the arms bearing the lift lips when the open shed heels are displaced, as is the case in the embodiments of FIGS. 1 to 12. The role of orifices 202*a* and 203*a* is essential here, as it makes it possible to transmit the movement of spreader 217 to the open shed heels 209 and 210 through arms 202 and 203 without displacing the latter.

It is thus unnecessary to provide a ramp for abutment of the arms bearing the lift lips when the open shed heels are spaced apart. The mass displaced by the electro-magnet against the elasticity of the arms or blades is smaller, which makes it possible to minimize the necessary power of the electro-magnet 215. The latter is permanently located above the blades or arms 202 and 203, which facilitates access thereto and the maintenance operations.

Finally, it may be noted that arm elements 217*a* and 217*b* of spreader 217 are provided, at their curved parts 217*e* and 217*f*, with a central orifice inside which arms 202 and 203 penetrate when the device is in the position of FIG. 17, i.e. when the lift lips are in their upper position and when the electro-magnet displaces spreader 217 and opens it. As arms 202 and 203 penetrate in the orifices of the curved parts 217*e* and 217*f*, they do not oppose the opening of spreader 217 and the latter may perform its function without exerting unnecessary effort on arms 202 and 203. This also enables the power that the electro-magnet 215 must furnish to be limited.

The third embodiment of the invention has been described with reference to an electro-magnet 215, but the invention is also applicable with any device capable of communicating to spreader 217 a sequential movement in the direction of the bottom board, such as a cam, bar, electric motor system or any other equivalent device.

The device 200 of the embodiment of FIGS. 13 to 17 may, like that of the embodiment of FIGS. 11 and 12, be included in a box or longitudinal case adapted to guide base 206, plates 202 and 203 and spreader 217, similar to that described with reference to the second embodiment.

What is claimed is:

1. A double-lift weave system for a weaving loom, the weave system comprising:

a plurality of hooks each having two arms extending from a base, each arm including a lift lip adapted to be selectively engageable with a knife of a griffe frame, an actuator disposed between said arms for moving said arms to selectively position said lift lips thereof from a first position wherein said lift lips are free of engagement with a knife to a second position wherein said lift lips are engageable with a knife, each hook further including two open shed heels adapted to be selectively engageable with open shed bars spaced on opposite sides of said hooks, said open shed heels being controlled by said actuator so as to be moveable from a first position spaced from the open shed bars to a second position wherein said open shed heels are engageable with the open shed bars.

2. The double-lift weave system of claim 1 wherein each of said arms is an elastic plate having an outer face, said lift lips extending from said outer faces of each of said elastic plates.

3. The double-lift weave system of claim 2 wherein each of said open shed heels extends from said outer face of said elastic plates in spaced relationship with respect to said lift lips.

4. The double-lift weave system of claim 2 including two additional elastic plates extending from said base, each of said two additional elastic plates including an outer face from which said open shed heels extend.

5. The double-lift weave system of claim 2 wherein each hook is mounted within a cage defined by two spaced partitions having a slideway therebetween in which said base of each hook is slidably moveable, said cage forming a support for said actuator.

6. The double-lift weave system of claim 5 wherein each of said partitions includes at least two spaced flanges extending outwardly therefrom and which define said slideway in which said base of said hook is slidably disposed, said open shed bars being formed with said partitions and extending outwardly on opposite sides thereof in spaced relationship with respect to said flanges.

7. The double-lift weave system of claim 6 including a core element mounted between said partitions of each of said cages, said core element including opposite recessed surfaces against which said elastic plates are engageable when in said first position thereof and wherein said elastic plates are deformed by activation of said actuator.

8. The double-lift weave system of claim 7 including a plurality of cages assembled together to form a module in which a plurality of hooks are moveably mounted.

9. The double-lift weave system of claim 1 wherein said actuator is an electromagnet.

10. The double-lift weave system of claim 1 wherein said actuator is a supple spreader disposed between said arms.

11. The double-lift weave system of claim 10 wherein said supple spreader includes curved ends engageable to urge said arms outwardly relative to one another.

12. The double-lift weave system of claim 10 in which said supple spreader includes a pair of arm elements having opposing arcuate segments, a bar member seated between said arm elements such that when said bar member is intermediate said arcuate segments, said arm elements are spaced at a first distance with respect to one another and wherein when said bar member is positioned between segments of said arm elements spaced from said arcuate segments, said arm elements are spaced at a greater distance with respect to one another.

13. The double-lift weave system of claim 10 wherein each of said arms is an elastic plate having an outer face, said lift lip extending from said outer face of each of said elastic plates, and two additional elastic plates extending from said base, each of said two additional elastic plates including an outer face from which said open shed heels extend.

14. The double-lift weave system of claim 13 including openings in each of said elastic plates, said supple spreader including elements extendable into said openings for engaging said open shed heels for moving said open shed heels between said first and second positions thereof.

15. The double-lift weave system of claim 14 in which said supple spreader includes a pair of arm elements having opposing arcuate segments, a bar member seated between said arm elements such that when said bar member is intermediate said arcuate segments, said arm elements are spaced at a first distance with respect to one another and wherein when said bar member is positioned between segments of said arm elements spaced from said arcuate segments, said arm elements are spaced at a greater distance with respect to one another.

16. The double-lift weave system of claim 15 wherein said actuator includes means for moving said supple spreader relative to said bar member.

17. The double-lift weave system of claim 1 wherein said arms are integrally formed with one another of an elastic metallic material.

18. In a weaving loom having at least one heddle frame connected to hooks which are moved by selective engagement with knives carried by two grille frames which move in phase opposition in a reciprocating manner, the improvement comprising:

each of said hooks having two arms extending from a base, each arm including a lift lip adapted to be selectively engageable with a knife of one of the grille frames, an actuator disposed between said arms for moving said arms to selectively position said lift lips thereof from a first position wherein said lift lips are free of engagement with a knife to a second position wherein said lift lips are engageable with a knife, each hook further including two open shed heels adapted to be selectively engageable with open shed bars spaced on opposite sides of said hooks, said open shed heels being controlled by said actuator so as to be moveable from a first position spaced from said open shed bars to a second position wherein said open shed heels are engageable with said open shed bars.

* * * * *